United States Patent [19]

Pina et al.

[11] 4,325,485

[45] Apr. 20, 1982

[54] TOOTHBRUSH HOLDER

[76] Inventors: Octavio U. Pina, c/o George Spector, 3615 Woolworth Bldg., 233 Broadway; George Spector, 3615 Woolworth Bldg., 233 Broadway, both of New York, N.Y. 10007

[21] Appl. No.: 128,569

[22] Filed: Mar. 10, 1980

[51] Int. Cl.[3] ..... A46B 17/02; A47G 29/08

[52] U.S. Cl. ..... 211/66; 211/96; 211/113; 248/110

[58] Field of Search ..... 211/66, 65, 60 R, 96, 211/113; 248/110

[56] References Cited

U.S. PATENT DOCUMENTS

| | | | |
|---|---|---|---|
| 2,118,465 | 5/1938 | Grose | 211/65 |
| 2,418,615 | 4/1947 | Barna | 211/65 X |
| 2,544,856 | 3/1951 | Perlin | 211/65 U X |
| 2,725,147 | 11/1955 | Vogler | 211/65 |
| 3,141,712 | 7/1964 | Holmes et al. | 211/66 X |
| 3,228,737 | 1/1966 | Kipnis | 248/113 X |
| 3,450,269 | 6/1969 | Simeti | 211/65 |

*Primary Examiner*—Stephen J. Novosad

[57] ABSTRACT

A wall-mounted rack from which a plurality of toothbrushes may be hung next to each other, the rack being molded of semi-resilient plastic and including a horizontal row of hooks on its front side each hook being a portion of a button that can be inwardly pushed into a recess so that the button pivots about its lower edge, and a toothbrush, suspended by its hole on the hook, and resting against a downward tab of the button, is thus forwardly pivoted at its lower end for easy grasp by being separated from adjacent brushes.

2 Claims, 4 Drawing Figures

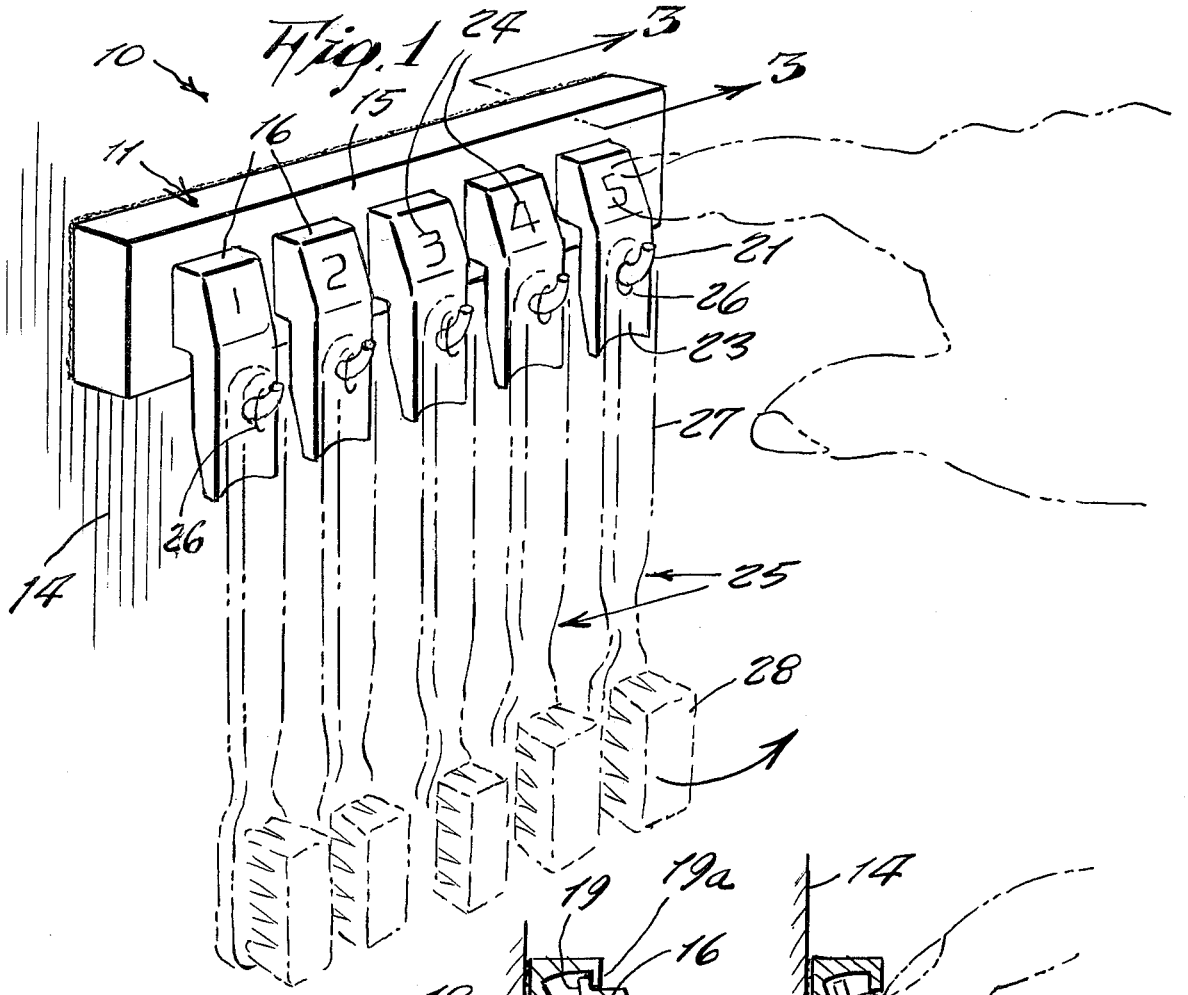
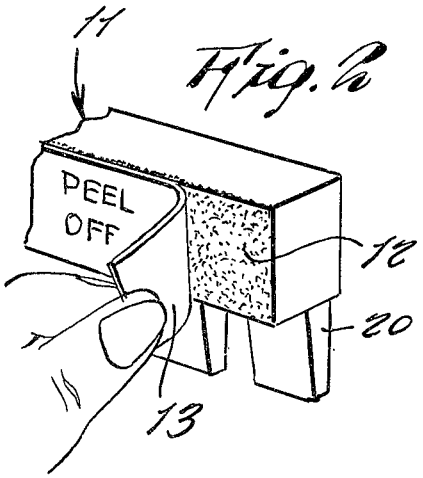
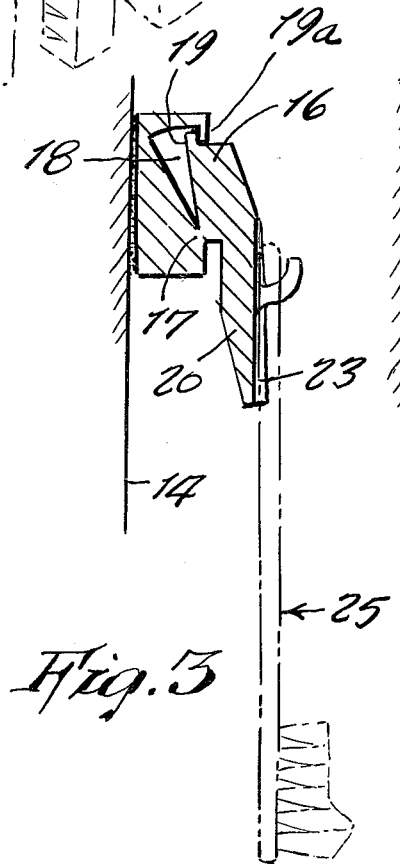
Fig. 3
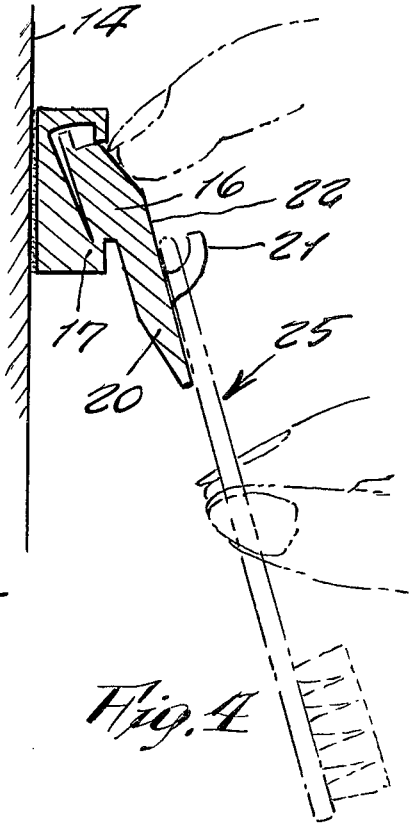
Fig. 4

TOOTHBRUSH HOLDER

This invention relates generally to wall-mounted toothbrush racks.

It is well known that conventional toothbrush holders such as are mounted on a bathroom wall and which support a row of toothbrushes such as for a family of persons, are made so that the toothbrushes are relatively close together and thus make it difficult for a person to remove his own without touching the others, and possibly thus contaminate them, especially if a person has a cold. Also such conventional holders are generally made with a row of vertical holes in which the brush handles are inserted so the brush bristles rest against the top surface of the holder, and thus easily become contaminated by contact therewith. This situation contributes to spread of mouth infections and is therefore in need of improvement.

Accordingly, it is a principal object of the present invention to provide a hang-a-brush toothbrush holder in which toothbrushes are suspended by their handle holes, so that the brush bristles do not conduct any object, and are surrounded by air all around so to prevent mildew thereof.

Another object is to provide a toothbrush holder which allows easy grasp and removal of any particular toothbrush without touching any other of the toothbrushes, even though they are close to each other along a row.

FIG. 1 is a perspective view of one design of the invention in which pushing a button above the brush, causes the brush to be pivoted forwardly in order to be easily grasped, thus allowing the brushes being close together and still allow any brush to be easily accessible without touching the other brushes by a hand.

FIG. 2 shows the mounting adhesive on the rear of the holder.

FIG. 3 is a cross sectional view on line 3—3 of FIG. 1, and showing a brush hanging vertically.

FIG. 4 is a view similar to FIG. 3 when the push button is pushed causing the brush to be tilted forwardly for easy access without disturbing other brushes alongside; it being noted that the invention is a one piecemember of semi-rigid plastic which allows pivoting of the pushbutton about a thin portion of the device.

Referring now to the drawing in greater detail, the reference numeral 10 represents a hang-a-brush toothbrush holder according to the present invention, wherein there is one-piece main body 11 of elongated block-like shape, and which on its rear side is coated with a pressure sensitive adhesive 12 that is temporarily covered by a removable, protective paper 13 which, as shown in FIG. 2 is peeled off when the main body is wished to be installed on a wall 14, such as that of a bathroom.

The main body is molded of a relatively semi-resilient plastic so that it is generally hard and stiff throughout, except at certain then portions thereof that flex so to serve as hinges, as described hereinafter. Upon a front side 15 of the main body there is a horizontal row of forwardly protruding buttons 16, and each of which is connected integrally to the main body by a thin portion along a lower rear edge of the button so as to form a hinge 17. The remaining upper portion of the button also protrudes rearwardly at its rear into a recess 18 in the main body. An upward lip 19 on an upper rear edge of the button abutts behind a downward stop 19*a* along a forward upper edge of the recess, so to limit the button against any forward pivoting about the hinge 17. When the main body and buttons are molded, the hinge in a normally relaxed position, holds the button in a forwardly pivoted position with the lip abutting the stop.

A downward tab 20 made integral with a lower forward protruding end of the button includes an upwardly curved hook 21 on its front side 22. A lower portion of the front side is increasing rough-shaped along a vertical axis, so to form a trough 23 to a lower edge of the tab.

A front face of each button may be slightly rearwardly inclined for easier visibility of a different numeral 24 molded therein, and which serves to identify any one of a plurality of toothbrush 25 hung from the hooks. Each hook supports one toothbrush by insertion of the hook into a hole 26 normally provided near an end of a handle 27 of most toothbrushes. The toothbrush, thus supported, hangs with its bristle brush head 28 hanging downward. The handle 27 rests in the trough. The above indicated construction permits the toothbrushes to be close together without touching each other. Also any desired brush can be easily removed from the holder for use without a person touching any other close adjacent brush.

This is accomplished by simply pressing the button, as shown in FIG. 1, so to cause the button to pivot into the recess, as shown in FIG. 4, thus causing a lowerpart of the toothbrush to be swinged forwardly away from the other vertically hanging toothbrushes so that it can then be conveniently grasped by its handle and lifted off the hook.

What is claimed as new, is:

1. A toothbrush holder for supporting a plurality of toothbrushes, comprising in combination a one-piece main body including a plurality of buttons integral therewith, means on each side button for supporting a toothbrush said buttons being in a horizontal row on a front side thereof, and a recess in said main body behind each said button, and a hinge about which said button pivots into said recess wherein said means comprises a downward tab on each said button which includes a forward hook on which one of said toothbrushes is hooked.

2. The combination as set forth in claim 1 wherein said tab pivots forwardly when said button is pivoted rearwardly, said toothbrush resting against said tab.

* * * * *